US007931423B2

(12) United States Patent
Bussey, Jr. et al.

(10) Patent No.: US 7,931,423 B2
(45) **Date of Patent: *Apr. 26, 2011**

(54) DRAINAGE ELEMENT

(75) Inventors: Harry Bussey, Jr., Marco Island, FL (US); Buddy Harry Bussey, III, Atlantic Highlands, NJ (US)

(73) Assignee: ICC Technologies Inc., Marlboro, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/322,642

(22) Filed: Feb. 5, 2009

(65) Prior Publication Data

US 2010/0111607 A1 May 6, 2010

Related U.S. Application Data

(63) Continuation-in-part of application No. 12/290,716, filed on Nov. 3, 2008.

(51) Int. Cl.
*E21B 11/00* (2006.01)

(52) U.S. Cl. ..... 405/45; 405/36; 383/1; 383/117

(58) Field of Classification Search ..... 405/36, 405/43, 45, 50; 383/1, 117, 32, 37
See application file for complete search history.

(56) References Cited

U.S. PATENT DOCUMENTS

| | | | | |
|---|---|---|---|---|
| 3,696,623 | A * | 10/1972 | Heine et al. | 405/19 |
| 3,928,979 | A * | 12/1975 | Terashima et al. | 405/50 |
| 3,932,319 | A * | 1/1976 | Clendinning et al. | 47/74 |
| 5,015,123 | A * | 5/1991 | Houck et al. | 405/45 |
| 5,030,031 | A * | 7/1991 | Brown | 405/36 |
| 5,788,413 | A * | 8/1998 | Peggs | 405/129.6 |
| 6,988,852 | B2 * | 1/2006 | Bussey et al. | 405/38 |
| 2004/0022973 | A1 * | 2/2004 | Bussey et al. | 428/35.2 |
| 2004/0057797 | A1 * | 3/2004 | Ring | 405/46 |
| 2006/0280557 | A1 * | 12/2006 | Ring et al. | 405/43 |

OTHER PUBLICATIONS http://www.merriam-webster.com/dictionary/sleeve.*

* cited by examiner

*Primary Examiner* — David J Bagnell
*Assistant Examiner* — Sean Andrish
(74) *Attorney, Agent, or Firm* — Francis C. Hand

(57) ABSTRACT

A preassembled drainage line element is fabricated at least in part of a biodegradable material, such as kraft paper or a plastic film. The biodegradable material may be perforated to impart a characteristic of water permeability to the material.

13 Claims, 5 Drawing Sheets

DRAINAGE ELEMENT

This application is a Continuation-in-Part of Ser. No. 12/290,716, filed Nov. 3, 2008 which is incorporated by reference herein.

This invention relates to a drainage element. More particularly, this invention relates to a drainage element for use in a sewage field, water drainage field, roadside drainage ditches, retaining walls, ball fields, or where gravel has been used for drainage and the like.

As is known, drainage elements have been constructed of loose aggregate, such as foam plastic elements, beads, and other light weight materials all encased in a net-like sleeve. In some cases, a perforated plastic pipe has been incorporated in the drainage element. Various techniques have also been known for making such drainage elements in a manufacturing plant so that the individual drainage elements may then be shipped to a construction site for use. Examples of such techniques are described in U.S. Pat. Nos. 5,015,123; 5,154,543; 5,535,499; 5,657,527; and 6,173,483.

Further, use of a netting to contain the aggregate within the drainage elements while allowing water and/or effluent to pass through also allows fine particles of solid material to pass through into the aggregate from the surrounding environment. As a result, over time, the solid material can build up in the drainage element to such a degree that the drainage element becomes clogged and prevents a flow of water therethrough. In some cases, use has been made of covers in order to prevent top dirt fill from falling into the drainage elements. In other cases, such as described in U.S. Pat. No. 6,854,924, proposals have been made to incorporate a barrier material in a drainage element between the netting and the aggregate to prevent the passage of outside media, such as sand, dirt and soil, through the netting.

In cases where a tubular netting is used in the fabrication of a drainage element of the above type, the tubular netting needs to be rucked onto a tube, i.e. drawn concentrically over the tube and gathered together. Thereafter, the netting can be drawn off the tube as the netting is filled with aggregate. Typically, the length of netting rucked onto a tube is sufficient to fabricate several drainage elements. However, rucking of the netting onto a tube is time consuming and cumbersome.

Also, as described in co-pending patent application U.S. Ser. No. 11/591,420, filed Nov. 2, 2006, use is made of a membrane to encase a mass of light weight aggregate to form a drainage element that allows water to pass through but prevents the passage of soil particles into the aggregate.

U.S. Pat. Nos. 6,857,818 and 6,988,852 describe a drainage element having a casing with a first part-circumferential portion, such as a netting, having a plurality of openings therein for passage of water and a second part-circumferential portion, such as a plastic web, having a porosity to prevent the passage of water therethrough.

In some cases, regulatory agencies will not approve the use a spun bonded polyester material as an encasing material in a drainage element used for septic systems on the belief that such a material would trap gases within the synthetic aggregate rather than allowing the gases to escape into the surrounding soil.

Accordingly, it is an object of this invention to provide a preassembled drainage element employing synthetic aggregate that allows the passage of gases over time through an encasing material.

Briefly, the invention provides a drainage element having a casing containing a mass of synthetic aggregate with a first part-circumferential portion, such as a netting, having a plurality of openings therein for passage of water and a second part-circumferential portion that is biodegradable, each part-circumferential portion of the sleeve 11 being less than 360°. Preferably, the biodegradable portion of the drainage element is made of paper, such as a Kraft paper, or of a plastic film.

After the drainage element has been in the ground for some time with the biodegradable portion at the top of the element, the biodegradable portion decays thereby allowing any gases within the synthetic aggregate to rise upwardly and escape directly into the soil surrounding the drainage element while also allowing water, such as rain water, to flow into the aggregate to wash out effluent that may have accumulated within the aggregate.

If some degree of permeability is required at the time of initial installation in the ground, the biodegradable paper or biodegradable film may be perforated with small openings to allow the escape of gases and the passage of water from above into the aggregate.

Also, if greater strength is required, the biodegradable material may be reinforced. For example, a Kraft paper may be reinforced with glass fibers.

As in the parent application, the preassembled drainage unit may be made with flaps on each peripheral portion of the casing.

These and other objects and advantages of the invention will come more apparent from the following detailed description taken in conjunction with the drawings wherein.

Figure 1:
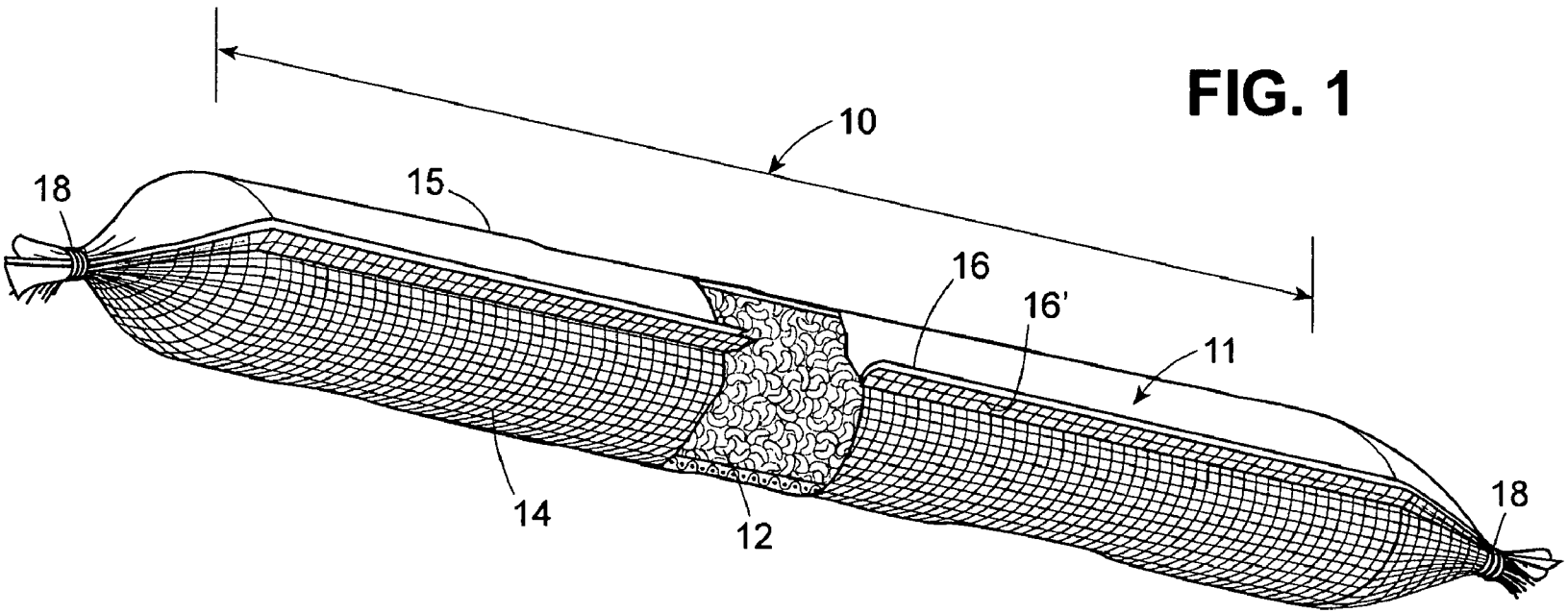
FIG. 1 illustrates a perspective view of a preassembled drainage line unit in accordance with the invention.
Figure 2:
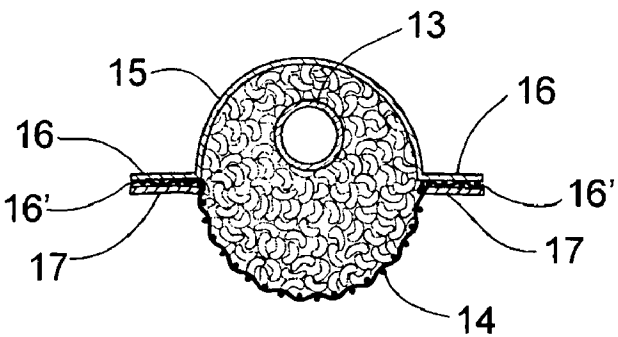
FIG. 2 illustrates a cross sectional view of a modified drainage unit in accordance with the invention.

Referring to FIGS. 1 and 2, the preassembled drainage line unit 10 is constructed of a self-contained sleeve 11, as viewed, a mass of light weight synthetic aggregate 12 disposed within the sleeve 11 and, optionally, with a perforated pipe 13 disposed within the aggregate 12 either centrally or offset from the center, as shown in FIG. 2, and extending outwardly of the sleeve 11 at each of two opposite ends of the drainage unit 10.

The sleeve 11 is of tubular shape, e.g. of cylindrical cross-section and is formed with a peripheral proportion of net material 14 and a separate second peripheral portion of a biodegradable material 15. As indicated in FIG. 2, each peripheral portion of material has a pair of radially outwardly directed flaps 16, 16' disposed in overlying contact relation and secured to each other.

As indicated in FIG. 1, the flaps 16, 16' extend along the entire length of the sleeve 11.

The net material 14 is characterized in having mesh openings that are large enough to allow water and solids to pass through and is particularly useful for septic tank systems.

The biodegradable material 15 is made of a Kraft paper with a weight in the range of from 10 to 100 pounds, and preferably a 40 to 60 pound weight. The material 15 is characterized in being such as to stop solids, such as sand and dirt from passing through, into the synthetic aggregate 12 when the material 15 is placed at the top of the drainage line unit 10 when placed in a trench in the ground, for example for use in a septic system.

Alternatively, the biodegradable material 15 may be made of a biodegradable plastic film of suitable thickness.

The biodegradable material 15 may be perforated, for example with pin holes or holes of a diameter or width of from 1/32 inch to 1/16 inch in order to provide a water permeable characteristic to the material 15 for purposes as described in the parent application that is incorporated by reference herein.

As illustrated, the biodegradable material constitutes one-half of the periphery of the sleeve 11.

When a drainage unit 10 is in use, the net material 14 is placed downwardly while the biodegradable material 15 is placed upwardly.

When a drainage line unit 10 is used in a septic system, the biodegradable material 15 prevents solids from passing downwardly into the unit 10. Clogging of the aggregate 12 within the drainage line unit 10 can thus be prevented.

The flaps 16, 16' may be secured together in any suitable manner, such as by sewing, heat sealing and/or gluing. In addition, a strip of biodegradable material 17, or other suitable material, may or may not be secured to the flap 16 of the biodegradable material 15 on an opposite side from the flap 16' of the net material 14 so as to sandwich the net material between two layers of biodegradable material. This also serves to reinforce and/or stiffen the secured together flaps 16, 16'. In order to improve the stiffening characteristics, the added strip 17 may be made of a greater thickness or ply than the biodegradable material 15.

The flaps 16, 16' are a size to extend outwardly from the drainage line unit 10 a distance of from 3 to 6 inches or more depending upon the use of the flaps 16.

As shown in FIG. 1, each end of the sleeve 11 of the drainage line unit 10 is bunched up and a tie 18 is disposed about the bunched up end to close the unit 10. Where a pipe extends through the sleeve 11, each end of the sleeve 11 would be secured by a tie 18 directly to the pipe.

Figure 3:
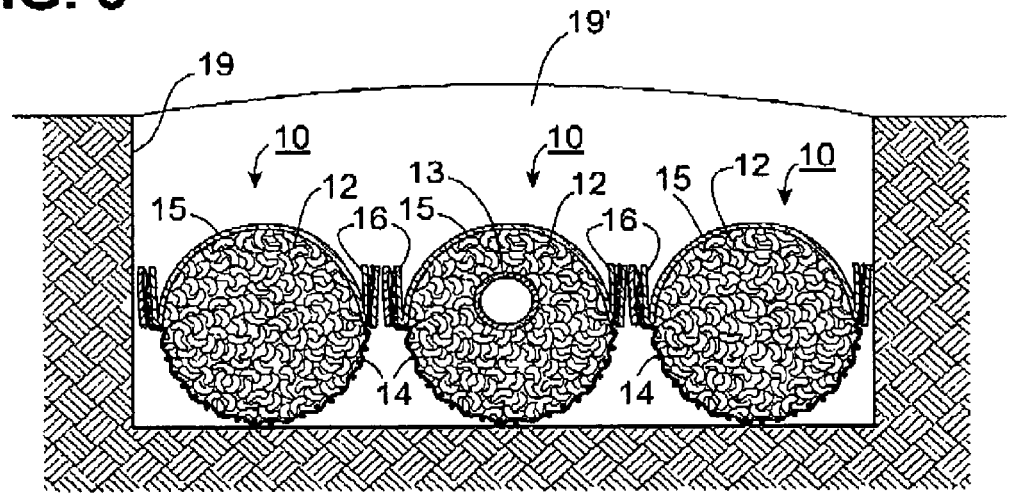
FIG. 3 illustrates three drainage units side by side with flaps pointing up in accordance with the invention.

Referring to FIG. 3, a plurality of drainage line units 10, for example three units, can be placed in a trench 19 in side-by-side parallel relation with the flaps 16, 16' disposed in an upwardly directed manner to serve as barriers to prevent the passage of soil 19' from passing downwardly between the drainage units 10. As shown, the flaps 16, 16' are placed in contact at the upper ends with either the flaps of an adjacent unit 10 or the sidewall of the trench 19.

Alternatively, the drainage line units 10 may be arranged with the flaps 16 directed downwardly (not shown) so as to add more protection for the net material 14 within the lower half of each drainage unit. That is, the flaps 16 cover the upper ends of the net material 14 so as to prevent soil and debris from passing through the upper ends of the net material 14 and into the aggregate 12. This reduces the risk of the aggregate becoming clogged with dirt and debris over time. Where necessary, the flaps 16,16' may be made of a width to cover 50% to 95% of the circumferential periphery of the lower half of the unit leaving a small strip of netting exposed for the outflow of an effluent, for example in a septic system.

Figure 4:
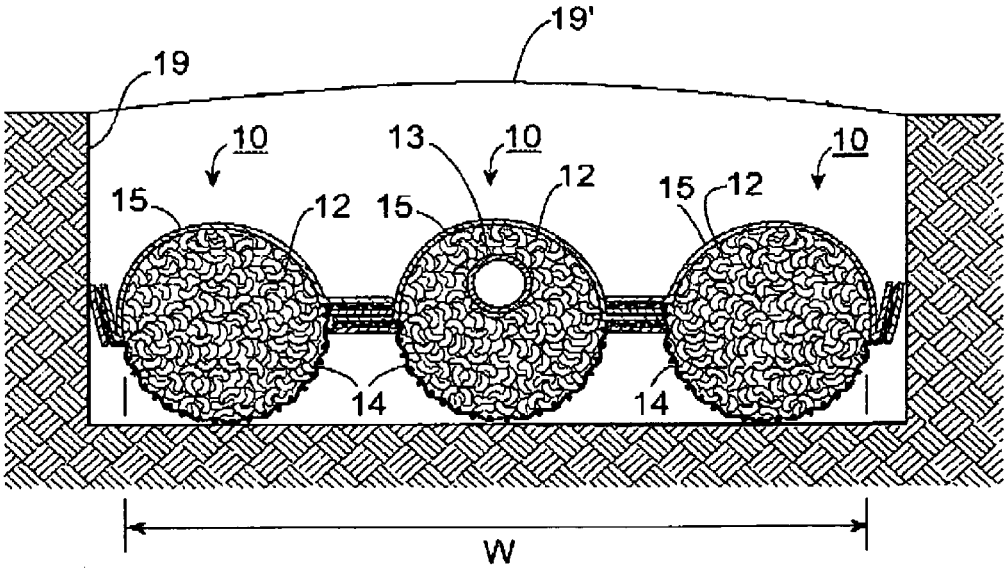
FIG. 4 illustrates three drainage units side by side with the flaps resting on each other in accordance with the invention.

Referring to FIG. 4, wherein like reference characters indicate like parts as above, an array of three drainage line units 10 are disposed in parallel within a trench 19 with the flaps 16,16' of adjacent units 10 being disposed in overlapping relation. As illustrated, the overlapped flaps 16, 16' are disposed horizontally within the trench 19. Also, as shown, the centermost drainage unit 10 is provided with a perforated pipe 13 that is disposed asymmetrically within the unit 10 to provide for more aggregate 12 below the pipe 13 than above the pipe 13. The remaining units 10 may be without pipes as shown or may also have pipes extending therethrough in centered or off-center manner.

Where each drainage unit 10 has a diameter of 10 inches with flaps of 3 inch width, the drainage line units 10 are spaced apart a distance of 3 inches, i.e. the distance defined by the overlapped flaps 16. The drainage line units 10 are thus 13 inches on center and have a width W of drainage surface area of 36 inches below the units 10. This provides the same volume for drainage surface area as three drainage units of 12 inch diameter in side-by-side contacting relation, i.e. being 12 inches on center. Thus, the use of the flaps 16, 16' allows the use of a smaller diameter of unit 10 and thereby less aggregate. Conversely, for drainage unit diameter of 12 inches and flaps of 3 inches, the width W of drainage surface area below the units would be 42 inches thereby providing a greater volume for drainage.

Figure 5:
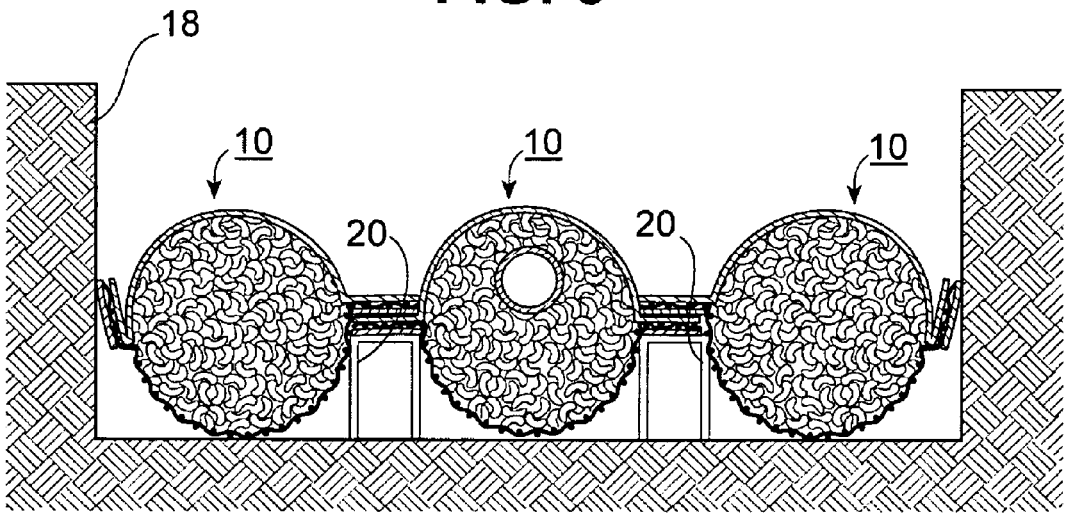
FIG. 5 illustrates a view similar to FIG. 4 with a bridge below and in support of the flaps in accordance with the invention.

Referring to FIG. 5 wherein like reference characters indicate like parts above, one or more bridges 20 are disposed under the overlapped flaps 16, 16' in supporting relation. The bridges 20 rest on the base of the trench 18 and may be of any suitable length and material to permit use in supporting the flaps 16, 16' during installation. For example, the bridges 20 may be made of aluminum, plastic, wood, cardboard, and the like. The bridges 20 facilitate the placement of the drainage line units 10 in place with the flaps 16, 16' in a proper horizontal position for use.

Figure 6:
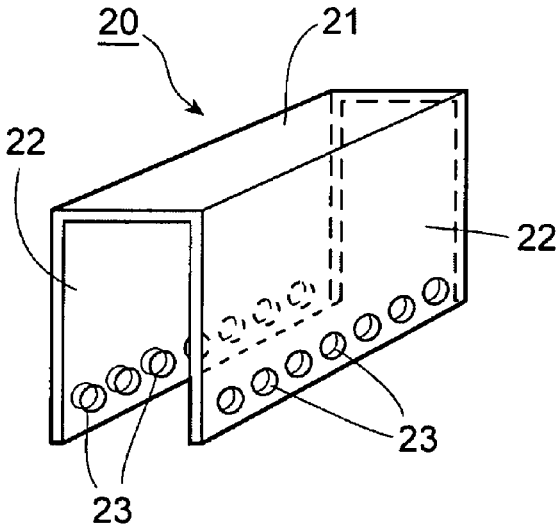
FIG. 6 illustrates a perspective view of a bridge in accordance with the invention.

As indicated in FIG. 6, each bridge 20 of U-shape with a flat top 21 and depending legs 22 formed with one or more rows of perforations 23 for the passage of effluent and water.

Alternatively, instead of using bridges 20, the flaps 16,16' of adjacent units may be secured together by heat sealing, ultrasonic sealing, clips, stapling, or otherwise, to form a self-supporting bridge.

Figure 7:
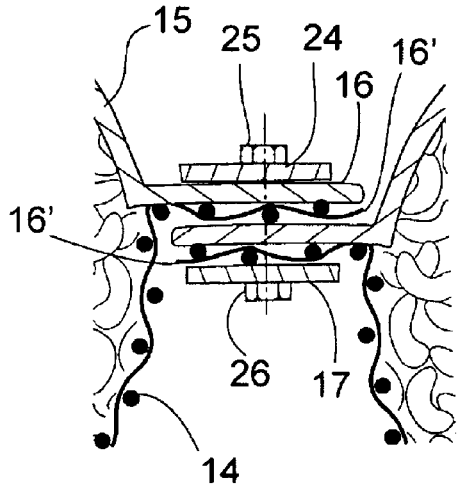
FIG. 7 illustrates a perspective view of a stiffener secured in place on a pair of overlapped flaps in accordance with the invention.

Referring to FIG. 7, the flaps 16 of adjacent drainage line units 10 may be secured together and stiffened by the addition and securement of a stiffener 24 to the overlapped flaps 16, 16'. The stiffener 24 may be made of a strip of plastics, metal, wood and the like and may be secured to the flaps 16, 16' by means of bolts 25 that pass through the stiffener 24 and flaps 16, 16' and are threaded into nuts 26 on the opposite side of the flaps 16, 16'. Alternatively, the stiffener may be secured in place by gluing, sewing and the like.

Typically, the stiffeners 24 are secured to the flaps 16, 16' after fabrication of a drainage line unit 10 and in the fabrication plant. This allows a plurality of drainage line units of equal length to be made and secured together in parallel side-by-side relation. These articulated units may then be rolled up in parallel into a bundle of three or six or ten or more units for shipment. Such bundles may be easily unrolled at a job site for laying within a prepared ditch of trench.

The provision of the flaps 16 on the preassembled drainage line units 10 is particularly useful in a drainage system comprised of a plurality of preassembled drainage line units 10 wherein at least some of the drainage line units 10 are disposed in at least two parallel rows. In this system, each drainage line unit 10 in a respective one of the rows includes a sleeve 11 having at least one flap 16 extending outwardly thereof and a mass of light weight synthetic aggregate 12 disposed within the sleeve 11.

The flap 16 of each unit 10 in a respective row may be directed upwardly to contact the flap 16 of a drainage line unit 10 in the adjacent row, such as shown in FIG. 3 or the flaps 16 may be disposed in overlying relation to space the drainage line units 10 in the rows apart, such as shown in FIG. 4.

Figure 8:
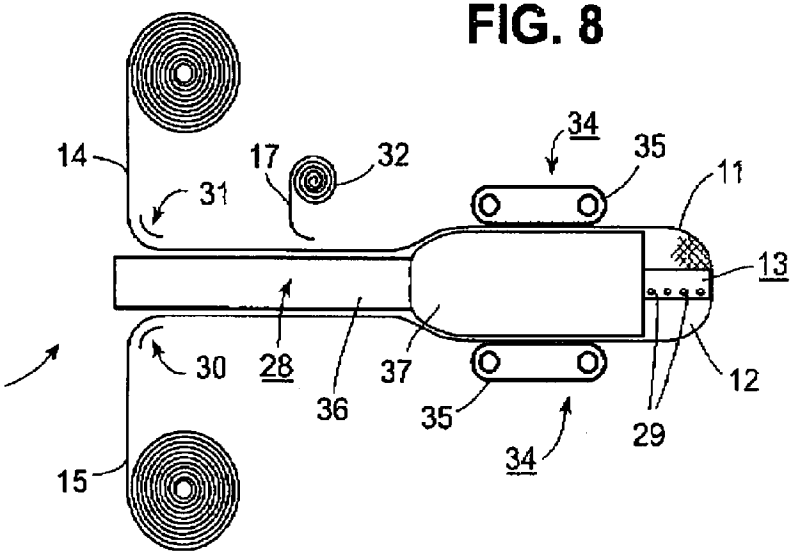
FIG. 8 illustrates a schematic view of a machine for making a drainage unit in accordance with the invention.

Referring to FIG. 8, wherein like reference characters indicate like parts as above, a machine for manufacturing a drainage line unit employs a barrel 28 through which a perforated pipe 13 with perforations 29 may be guided via a guide tube (not shown) in centered or offset relation and through which the aggregate 12 may be blown within the annular space between the guide tube and the barrel 28.

In addition, a forming collar 30 is disposed around the lower half of the barrel 28 in order to deform a continuous web of biodegradable material 15 into a semi-cylindrical shape with the longitudinal edges splayed outwardly to form the flaps 16. A similar forming collar 31 is disposed over the upper half of the barrel 28 to shape a continuous web of net material 14 into a similar semi-cylindrical shape with the longitudinal edges splayed outwardly to form the flaps 16'. A 10 inch Dual Collar from Forming By Ernie, Inc. of Houston, Tex. may be used to form the two webs 14, 15.

As the two deformed webs of material 14, 15 are brought together on the barrel 28, the flaps 16, 16' are guided over each other along the sides of the barrel 28. In addition, a separate strip of biodegradable material 17 is supplied on top of each flap 16' of net material 14 from a suitable supply roller assembly 32 (only one of which is indicated in FIG. 8) located to each side of the barrel 28.

Figure 9:
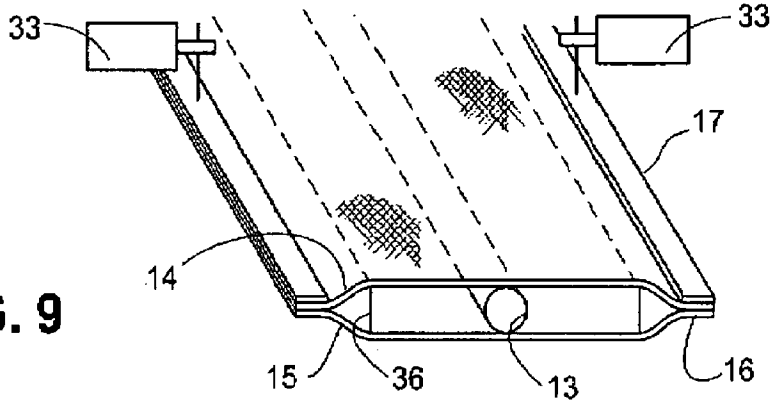
FIG. 9 illustrates a cross-sectional view of an intermediate part of the machine of FIG. 8.

Referring to FIG. 9, the machine 27 also employs two sewing machines 33, one on each side of the barrel 28 for securing the overlying flaps 16', 16 and, where employed, the strip 17 together so that each flap of net material 14 is sandwiched between two layers of biodegradable material 15, 17. Preferably, each sewing machine 33 is of a type to secure the flaps 16, 16' and strip 17 together using a chain stitch.

After securement of the flaps 16,16' of the two streams of deformed webs of material 14,15, the resulting sleeve 11 is directed off the end of the barrel 28, for example by a pair of capstans 34 that have endless belts 35 driven in a direction to drive the sleeve 11 over and off the barrel 28.

At the start of an operation to make a drainage unit, the forward end of the sleeve 11 is closed on itself downstream of the end of the barrel 28 or secured to a perforated pipe 13 extending from the barrel 28. Operation of the machine 27 then proceeds so that the perforated pipe 13 is fed through and out of the barrel 28 while the attached sleeve 11 is pulled along with the pipe 13 and driven by the capstans 34. In the case where there is no pipe 13, the sleeve 11 is positively driven off the barrel 28 by the capstans 34.

At the same time as the pipe is being driven, aggregate 12 is blown through and out of the barrel 28 and into the closed end of the sleeve 11 until a desired length of drainage unit has been formed. At that time, blowing of the aggregate 12 is stopped and the sleeve 11 is secured to the perforated pipe 13, or to itself in the absence of a pipe, to form the back end of a drainage unit. The sleeve 11 is then cut at that point to separate the drainage unit from the next drainage unit to be formed in the same manner.

Where a series of drainage units are being fabricated, the back end of the sleeve 11 is tied to the pipe 13, or to itself, at two spaced apart points and cut between those two points so as to simultaneously form the back end of one drainage unit and the forward end of the next drainage unit.

The barrel 28 of the machine is typically made as a tube of constant circular cross-section. Alternatively, the barrel 28 may be shaped to have a square or rectangular intermediate section 36, as shown in FIG. 9, disposed between sections 37 of round or cylindrical cross section (only one of which is shown). In this embodiment, the sewing machines 33 are placed adjacent the intermediate section 36 to sew the flaps of the two webs of material 14,15 and strip 17 together.

An intermediate section 36 of the barrel 28 that is of rectangular cross-section is of particular advantage where the two webs 14,15 of material are disposed without a flap, that is, with the longitudinal edges of the webs disposed in overlapped relation. In this embodiment, the overlapped edges may be secured together by gluing or heat sealing, such as described in co-pending patent application Ser. No. 11/591,420. The outside surface of the barrel 28 may also be provided with a Teflon strip (not shown) to protect against a hot melt glue becoming adhered to and building up on the surface of the barrel 28. The outside surface of the barrel 28 may also be provided with a track or rail that provides a hardened flat surface against which a pressing roller (not shown) may roll in order to press the overlapped edges of the webs of material 14, 15 and strip 17 together. In this respect, the web of biodegradable material 15 would located against the track and the strip of biodegradable material 17 would be disposed to the opposite side of the web of net material 14 so as to sandwich the net material between two layers of biodegradable material. Use of a hot melt glue to secure the two layers of biodegradable material would then be used. The pressing roller would insure that the two layers of biodegradable material are pressed together to secure the net material in place.

The intermediate section 36 of the barrel 28 may have the guide tube for the pipe 13 centered therein while the following circular section 37 of the barrel 28 is offset downwardly from the intermediate section 36 with the guide tube for the pipe thus being offset from the axis of the circular section 37. In this embodiment, the pipe 13 becomes disposed in an off-centered position with a drainage unit 10 as shown in FIG. 2.

Further, instead of using a cylindrical section 37, the barrel 28 may have an end section of ovate or rectangular shape to form a preassembled drainage line unit of like cross-sectional shape.

Typically, a standard size drainage element fabricated on the machine 27 is of a 10 inch diameter with flaps of 6 inch width. In this respect, the barrel has an outside diameter of 10 inches and the sewing machines 33 are positioned adjacent the barrel 28 to form a stitched seam that is close to the barrel 28. Thus, as the resulting sleeve 11 is moved off the barrel 28 and aggregate 12 is blown into the sleeve 11, the sleeve 11 is able to expand under the blowing force on the aggregate into a circular cross-section of an inside diameter of slightly more than 10 inches.

In order to fabricate a larger diameter drainage element, each sewing machine 33 is moved away from the barrel 28, e.g. by 1 inch. The resulting seam that is stitched into the flaps 16,16' allows the webs 14,15 to expand between the two seams into a larger diameter than 10 inches. For example, moving each sewing machine by 1 inch farther from the barrel 28, provides an added 4 inches to the circumference of the sleeve 11. This calculates to an increase in diameter of the sleeve 11 and, thus, the drainage element of 1.3 inches.

The machine 27 is, thus, able to fabricate drainage elements of different diameters without having to replace the barrel 28, the forming collars 30, 31 or other components of the machine 27. The only adjustments are those required to move the sewing machines 33 relative to the barrel 28.

Figure 10:
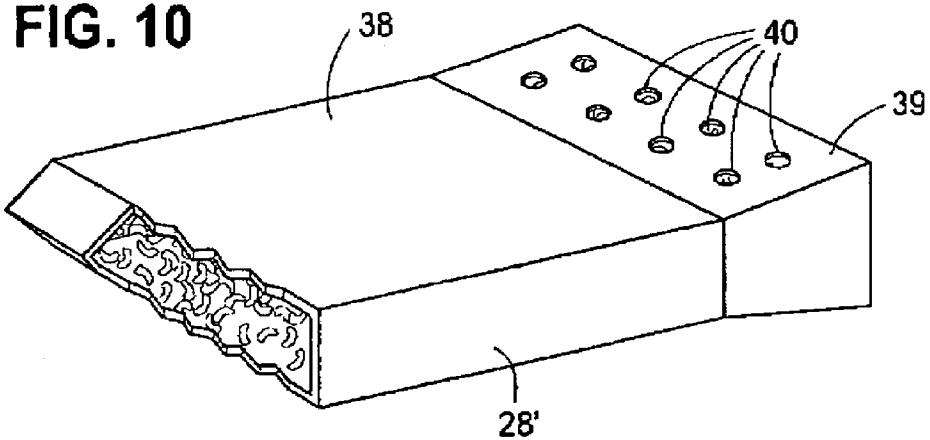
FIG. 10 illustrates a part perspective view of an end section of a modified barrel for making a drainage unit in accordance with the invention.
Figure 11:
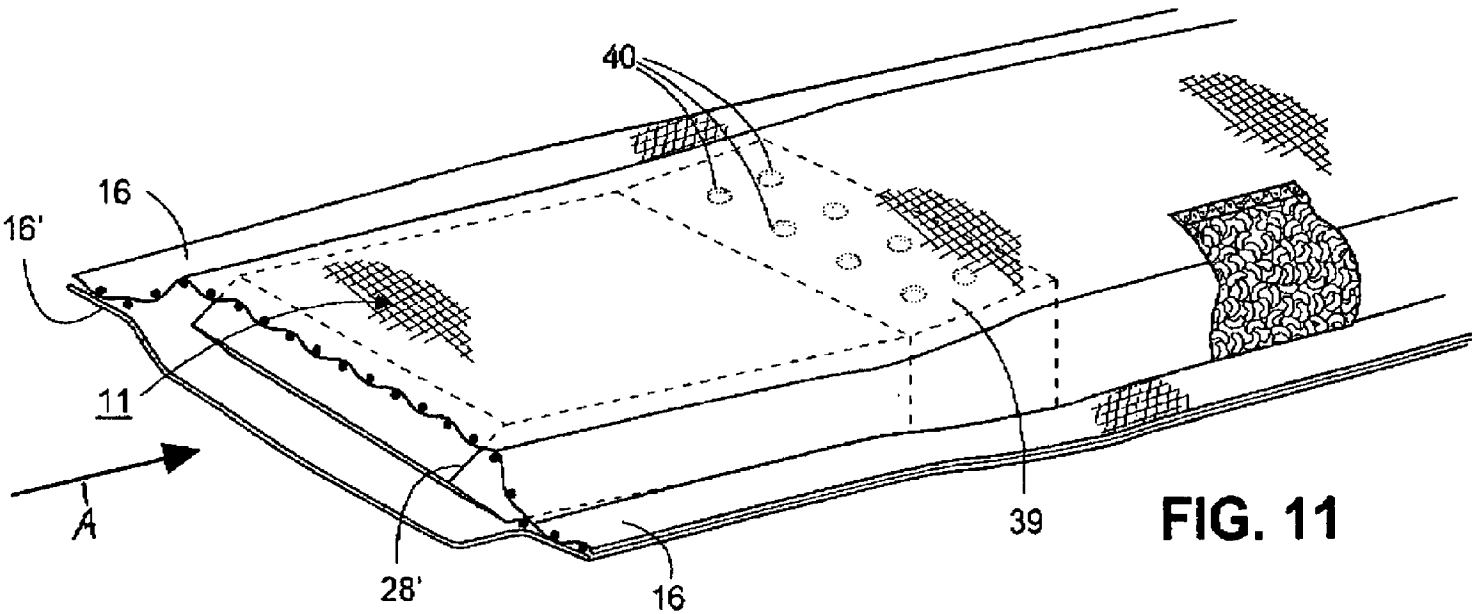
FIG. 11 illustrates a view of the modified barrel during manufacture of a drainage unit in accordance with the invention.

Referring to FIGS. 10 and 11, wherein like reference characters indicate like parts as above, the 28' barrel may be formed with an end section including a first portion 38 having a rectangular cross-section and an adjacent second portion 39 having a rectangular cross-section of increasing size relative to the first portion 38 in at least one transverse direction, i.e. vertically upward and vertically downward. The second portion 39 is also provided with a plurality of vent openings 40 for the passage of air from within the barrel 28'.

During operation, as the sleeve 11 is moved off the barrel 28' in the direction indicated by the arrow A and the perforated pipe 13 is being moved forwardly, aggregate 12 is blown through and out of the barrel 28' into the sleeve 11 and about the pipe 13. During passage through the enlarged portion 39, the aggregate 12 is compacted so that the individual elements of the aggregate 12 interlock with each other and, thereby, retain the shape of the enlarged portion 39. At the same time, air is vented through the vent openings 40 out of the barrel 28'.

By way of example, the barrel 28' may be used to form a preassembled drainage unit of generally rectangular shape (with bowed sides) with a width of 36 inches and a height of 12 inches. The drainage unit may optionally have a perforated pipe extending therethrough either on center or off center. Such a drainage unit may be easily shipped in large numbers within a minimum of space to a construction site having a trench of a nominal 36 inch width. The drainage units may then be deposited into the trench and interconnected in the usual manner in a minimum of time relative to using a triangular array of three drainage units wherein the uppermost drainage unit has a pipe while the other drainage unit have no pipe.

Alternatively, a vented extender (not shown) may be removably mounted on an end of the intermediate section 36 of the barrel 28 instead of the circular section 37. In this case, the extender would have a cross-section of greater area than and different shape from the cross-section of said barrel. As above, during operation, air would pass out of the vents of the extender while the aggregate 12 is compacted so that the individual elements of the aggregate 12 interlock with each other and, thereby, retain the shape of the enlarged extender.

The invention further provides a simple economical method for fabricating a drainage element with a sleeve that is at least partially biodegradable.

What is claimed is:

1. A preassembled drainage unit comprising a self-contained sleeve having a first part-circumferential portion thereof made of netting having a plurality of openings therein for the passage of water and a second part-circumferential portion thereof made of a biodegradable material for stopping solids from passing therethrough; and a mass of light weight synthetic aggregate disposed within said sleeve.

2. A preassembled drainage unit as set forth in claim 1 wherein said first part-circumferential portion of netting has mesh openings to allow water and solids to pass through and said second part-circumferential portion is made of kraft paper.

3. A preassembled drainage unit as set forth in claim 2 wherein said paper has a weight of from 40 to 60 pounds.

4. A preassembled drainage unit comprising a sleeve of elongated tubular shape having a first peripheral portion of net material having a plurality of openings therein for the passage of water and having a pair of radially outwardly directed flaps extending along the entire length of said portion, a second peripheral portion of biodegradable material for stopping solids from passing therethrough separate from said first peripheral portion and having a pair of radially outwardly directed flaps extending along the entire length of said second portion, each said flap of biodegradable material being secured to a respective one of said pair of flaps of said net material; and a mass of light weight synthetic aggregate disposed within said sleeve.

5. A preassembled drainage unit as set forth in claim 4 wherein said biodegradable material is one of a perforated paper and a plastic film.

6. A preassembled drainage unit as set forth in claim 4 wherein said sleeve is self-contained and defines a tubular circular cross-sectional shape.

7. A preassembled drainage unit as set forth in claim 4 further comprising a perforated pipe disposed within said aggregate and extending outwardly of said sleeve at each of two opposite ends of the drainage unit.

8. In combination, an array of preassembled drainage units, each said unit including a self-contained sleeve of elongated tubular shape having at least one peripheral portion thereof of biodegradable material for stopping solids from passing therethrough, at least one peripheral portion thereof of net material having a plurality of openings therein for the passage of water and a pair of radially outwardly directed flaps and a mass of light weight synthetic aggregate disposed within said sleeve; and each of said units being disposed in spaced relation to an adjacent unit within a trench and having a respective flap thereof disposed in overlapping contact relation to a respective flap of said adjacent unit.

9. The combination as set forth in claim 8 wherein at least one of said units has a perforated pipe disposed therein and extending outwardly thereof at each of two opposite ends thereof.

10. The combination as set forth in claim 9 wherein said perforated pipe is disposed in asymmetric relation within said one unit.

11. The combination as set forth in claim 10 wherein each peripheral portion of net material of each said unit is downwardly disposed and each said peripheral portion of biodegradable material is upwardly disposed.

12. A preassembled drainage unit comprising a self-contained sleeve of tubular circular cross-sectional shape having a first part-circumferential portion thereof made of netting characterized in having a plurality of openings therein for the passage of water and solids and a second part-circumferential portion thereof characterized in being made of a biodegradable material for stopping solids from passing therethrough; and a mass of light weight synthetic aggregate disposed within said sleeve.

13. A preassembled drainage unit as set forth in claim 12 wherein said biodegradable material is made of one of a biodegradable paper and a biodegradable plastic film.

* * * * *